US006822622B2

(12) United States Patent
Crawford et al.

(10) Patent No.: US 6,822,622 B2
(45) Date of Patent: Nov. 23, 2004

(54) ELECTRONICALLY RECONFIGURABLE MICROWAVE LENS AND SHUTTER USING CASCADED FREQUENCY SELECTIVE SURFACES AND POLYIMIDE MACRO-ELECTRO-MECHANICAL SYSTEMS

(75) Inventors: Thomas M. Crawford, Westminster, CO (US); P. Keith Kelly, Lakewood, CO (US); Farzin Lalezari, Boulder, CO (US); Theresa C. Boone, Boulder, CO (US)

(73) Assignee: Ball Aerospace & Technologies Corp, Boulder, CO (US)

( * ) Notice: Subject to any disclaimer, the term of this patent is extended or adjusted under 35 U.S.C. 154(b) by 0 days.

(21) Appl. No.: 10/208,507

(22) Filed: Jul. 29, 2002

(65) Prior Publication Data

US 2004/0017331 A1 Jan. 29, 2004

(51) Int. Cl.[7] ..... H01Q 15/02
(52) U.S. Cl. ..... 343/909; 343/754; 343/756
(58) Field of Search ..... 343/909, 753, 343/754, 756, 767, 770, 700 MS

(56) References Cited

U.S. PATENT DOCUMENTS

| | | | | |
|---|---|---|---|---|
| 4,785,310 A | | 11/1988 | Rosen | |
| 4,814,785 A | | 3/1989 | Wu | |
| 5,162,809 A | | 11/1992 | Wu | |
| 5,208,603 A | | 5/1993 | Yee | |
| 5,917,458 A | | 6/1999 | Ho et al. | |
| 5,945,946 A | * | 8/1999 | Munger | 343/754 |
| 5,949,387 A | | 9/1999 | Wu et al. | |
| 5,959,594 A | | 9/1999 | Wu et al. | |
| 6,147,572 A | * | 11/2000 | Kaminski et al. | 343/909 |
| 6,198,438 B1 | | 3/2001 | Herd et al. | |
| 6,204,819 B1 | | 3/2001 | Hayes et al. | |
| 6,208,316 B1 | * | 3/2001 | Cahill | 343/909 |
| 6,218,978 B1 | * | 4/2001 | Simpkin et al. | 343/909 |

OTHER PUBLICATIONS

Lee, Y.C., "High–q Tunable Capacitors and Multi–way Switches Using Mems for Millimeter–wave Application", online presentation at http://mems.colorado.edu/c1.res.ppt/ppt/rf.ppt_rev.09.98/top.shtml?nomenu, University of Colorado, 2000.

Wang, Chunjun, et al., "Flexible Circuit–Based RF MEMS Switches", Proceedings of 2001 ASME International Mechanical Engineering Congress and Exposition, Nov. 11–16, 2001, New York, NY, ASME 2001.

Hoivi, Nils, M.A., et al., "Digitally Controllable Variable High–Q MEMS Capacitor for RF Applications", NSF Center for Advanced Manufacturing and Packaging of Microwave, Optical and Digital Electronics, University of Colorado, 2001.

Wu, Huey D., et al., "MEMS Designed for Tunable Capacitors", NSFCenter for Advanced Manufacturing and Packaging of Microwave, Optical and Digital Electronics, University of Colorado, 1998 IEEE Microwave Theory and Techniques Society, Jun. 3–11, 1998.

(List continued on next page.)

*Primary Examiner*—Hoang V. Nguyen
(74) *Attorney, Agent, or Firm*—Sheridan Ross P.C.

(57) ABSTRACT

A radio frequency reconfigurable lens is provided. In particular, a lens comprising at least two opposed frequency selective surface sheets is provided. A relative phase shift may be imparted to an incident radio frequency wave by varying the distance between at least some of the unit cells of a first of the FSS sheets and adjacent unit cells on a second of the FSS sheets. In order to provide a desired phase taper across the width of a lens, and/or to provide different phase shift amounts, pairs of FSS surfaces having controllable columns or rows can be cascaded together. According to an additional aspect of the present invention, radio frequency waves can be scanned by cascading multiple tunable stages. The present invention also provides a radio frequency shutter.

42 Claims, 13 Drawing Sheets

OTHER PUBLICATIONS

Irwin, Ronda, et al., "Quick Prototyping of Flip Chip Assembly with MEMS", University of Colorado, 1998 IEEE Radio and Wireless Conf. Colorado Springs, Co, Aug. 9–12, 1998.

Harsh, Kevin F., et al., "Flip–Chip Assembly for SI–Based RF MEMS", NFS Center for Advanced Manufacturing and Packaging of Microwave, Optical and Digital Electronics, University of Colorado, 1999 IEEE International Conf. on Microelectrochemical Systems, Orlando, Fl, Jan. 17–21, 1999.

Gupta, K.C., "MEMS–based Reconfigurable Slot Antennas", NSF Center for Advanced Manufacturing and Packaging of Microwave, Optical and Digital Electronics, University of Colorado, Workshop on Affordability and Cost Reduction for Radar Systems, AL, Apr. 5–6, 2000.

Gupta, K.C., et al., "Design of Frequency–Reconfigurable Rectangular Slot Ring Antennas", NSF Center for Advanced Manufacturing and Packaging of Microwave, Optical and Digital Electronics, University of Colorado, 2000 IEEE APS International Symposium, Salt Lake City, UT, Jul. 16–21, 2000.

Defense Advanced Research Projects Agency, Special Projects Office, overview of "Reconfigurable Aperture Program (RECAP)", available at www.darpa.mil/spo/programs/recap.htm, downloaded Feb. 19, 2002.

Defense Advanced Research Projects Agency, Special Projects Office,"Agent & Contractor Information" for RECAP Program, available at www.darpa.mil/spo/programs/RECAP/afrl.htm, downloaded Feb. 19, 2002.

Naval Research Lab., Washington, D.C., Advanced Radar Systems Branch, Rao, et al., "Measurement Results of an Affordable Hybrid Phased Array Using a Radant Lens," Report No.: NRL/MR/5320–00–8439, May 15, 2000, NTIS Accession No.: ADA377694/XAB (Abstract).

University of Massachusetts at Amherst, Rao, et al., "An Affordable Scanning Array Using a Radant Lens", pp. 331–348, Sep. 1999, *Proceedings of 1999 Antenna Applications Symposium*, INSPEC Abstract No.: B2000–06–6320–017.

Aristotle University, Alpaslan, et al., "Electronically Tunable Frequency Selective Surfaces", vol. 1, pp. 130–132, May 1998, *Proceedings of 1998 International Symposium on Electromagnetic Theory*, INSPEC Abstract No.: B1999–08–5260–010.

Zhang, et al., "Analysis of Mechanically Tunable Frequency Selective Surfaces", vol. 8, No. 4, pp. 7–16, *1997, Journal of Systems Engineering and Electronics*, E.I. No.: EIP98024088000 (Abstract).

Morrow, et al., "Measurement and Modeling of a Microwave Active–Patch Phased Array for Wide–Angle Scanning", vol. 45, No. 2, pp. 297–304, Feb. 1997, *IEEE Transactions on Antennas and Propagation* (Abstract).

IEEE, Herper, et al., "An Octave Band Electronic Scan Cylindrical Array", vol. 2, pp. 670–673, May 1990, *1990 International Symposium Digest, Antennas and Propagation, Institute of Electrical Engineers, Merging Technologies for the 90's*, INSPEC Abstract No.: B91057846.

Naval Research Lab., Washington, D.C., Electromagnetics Branch, Coleman, et al., "Performance Analysis of a Three–Dimensional Microwave Lens in a Cylindrical Array Scanning Application", Jul. 1983, Interim Report (Abstract).

Haykin, "Performance Analysis of a Radar Signal Processing System with Continuous Electronic Array Scanning", vol. 13, No. 3, pp. 201–227, 1977, *Information Sciences*, INSPEC Abstract No.: B78025412.

Park, "Radant Lens—Alternative to Expensive Phased Arrays", vol. 24, pp. 101–105, Sep., 1981, *Microwave Journal*.

Rao, et al., "Voltage Controlled Ferroelectric Lens Phased Arrays", pp. 1624–1627, Naval Research Laboratory publication.

Ma, et al., "Smart Coating Materials for Frequency Selective Surfaces", vol. 1916, pp. 320–328, *SPIE*.

Lakhtakia, "Strategies for Tunable Frequency Selective Surfaces", vol. 1489, pp. 108–111, 1991, *SPIE, Structures Sensing and Control*.

Poulton, et al., "Microwave Lenses for Beam–Scanning Applications", vol. 1, pp. 559–562, 1985, *1985 IREECON International: 20th International Convention & Exhibition of the Institution of Radio and Electronics Engineers Australia, Digest of Papers*.

IEEE, Proudfoot, et al., "Design and Testing of a Lightweight, Planar Microwave Lense", pp. 495–498, 1992.

Chan, et al., "Analysis of a Tunable Frequency–Selective Surface on an In–Plane Biased Ferrite Substrate", vol. 13, No. 2, Oct. 5, 1996, *Microwave and Optical Technology Letters*.

Chekroun, et al., "Radant: New Method of Electronic Scanning", pp. 45–53, Jan. 1989, *Microwave Journal*.

Naval Research Lab., Radar Division, "Radant Lens", available at http://radar–www.nrl.navy.mil/Areas/Radant/, downloaded Nov. 14, 2000.

* cited by examiner

ELECTRONICALLY RECONFIGURABLE MICROWAVE LENS AND SHUTTER USING CASCADED FREQUENCY SELECTIVE SURFACES AND POLYIMIDE MACRO-ELECTRO-MECHANICAL SYSTEMS

FIELD OF THE INVENTION

The present invention relates to reconfigurable microwave lenses and shutters. In particular, the present invention relates to reconfigurable microwave lenses and shutters using cascaded frequency selective surfaces and polyimide-macro-electro-mechanical systems.

BACKGROUND OF THE INVENTION

Antennas are used to radiate and receive radio frequency signals. The transmission and reception of radio frequency signals is useful in a broad range of activities. For instance, radio wave communication systems are desirable where communications are transmitted over large distances. In addition, the transmission and reception of radio wave signals is useful in connection with obtaining position information regarding distant objects.

Antennas are generally formed to receive and transmit signals having frequencies within defined ranges. In addition to such frequency selectivity, antennas having a beam that can be pointed or steered in space can be provided. The pointing of an antenna beam can be accomplished by physically moving the radiator element or elements of the antenna. The beam of an antenna can also be steered electronically. The steering of an antenna beam is useful because it allows an antenna to focus on a distant receiver or transmitter, maximizing the gain of the antenna with respect to the distant transmitter or receiver. In addition, the pointing of an antenna beam allows the location of distant objects to be determined with respect to the antenna. Furthermore, by moving (or scanning) a beam of radio frequency radiation, a wide area can be surveyed by a single antenna.

In order to control the frequencies received by or emitted from an antenna, frequency selective surfaces (FSS) are known. With reference now to FIG. 1A, a band pass FSS 100 in accordance with the prior art is illustrated. In the band pass FSS of FIG. 1A, resonant slots 104 are formed in a layer of metal 108 overlaying a substrate 112. The slots behave in the same fashion as a resonant L-C shunt admittance pair, as illustrated in FIG. 1B, for which the resonant frequency occurs when $$\omega^2 = \frac{1}{LC}.$$

The admittance, $Y_p$ of the L-C shunt admittance pair may be defined as a function of frequency as $Y_p$=jB=j $$\left(\omega C - \frac{1}{\omega L}\right).$$

By altering the width and length of the slots, and/or their relationship to one another, the effective values of L and C may be changed, thereby changing the resonant frequency response of the band pass FSS. Such band pass FSS structures can be designed to have very low transmission losses within the pass band. However, a conventional band pass FSS 100 such as the one illustrated in FIG. 1 cannot be controlled to selectively alter its transmission pass band, and associated transmission phase, while the FSS 100 is operatively connected to an antenna. Therefore, a conventional band pass FSS 100 is not able to selectively modify an antenna beam, or, specifically, to scan the beam towards a target.

Microwave lenses that allow an antenna beam to be scanned by modifying the refractive index of a panel made from an artificial dielectric are known. For example, in a RADANT® lens an artificial dielectric is formed from grids of cut wires and continuous wires, with diodes bridging the gap between cut wire segments. By biasing the diodes either on or off the index of refraction can be changed, thereby altering the phase of transmitted radio frequency radiation. However, such devices require the integration of thousands of discrete, lossy components (e.g., diodes). In addition, RADANT® lenses are heavy, and therefore are difficult to deploy, particularly in mobile or in space-based applications.

Phased array antennas that provide scanning beams are also known. In a phased array antenna, the phase of the radio frequency signals provided to individual antenna radiator elements is altered across the surface of the antenna. Conventional phased array antennas typically require the use of a large number of semiconductor switches or micro-electro mechanical (MEMs) devices to control the phase of the individual radiator elements. Accordingly, conventional phased array antennas are complicated and expensive to implement. In addition, the use of lossy components such as semiconductor switches and traditional micro-electro-mechanical devices results in large insertion losses.

Radio frequency shutters that can be selectively opened or closed to transmit or reflect radio frequency signals are also known. For example, an electronic diode shutter may be constructed by connecting diodes across the midpoint of slot elements in a conducting FSS sheet. By biasing the diodes either on or off, the resonant characteristics of the slots can be changed, thereby detuning the slots and altering the transmission and reflection properties of the FSS. Such shutters may be used to control the radar cross section of antennas or to protect antenna receiver circuitry from being damaged by high-power incident radio frequency signals while in the off state. However, shutter implementations employing thousands of discrete components entail the same types of liabilities as do diode lenses. Namely, complexity, loss, operating power, and weight.

For the above stated reasons, it would be desirable to provide a lens for use in connection with radio frequency antennas that allowed the phase of a transmitted radio frequency wave to be controlled, while exhibiting low insertion losses. Furthermore, it would be advantageous to provide such a device to permit the scanning or pointing of radio frequency radiation that required low power to operate and was relatively simple to construct and implement. In addition, it would be desirable to provide such a lens that was reliable in operation and that was suitable for use in connection with a wide variety of applications. It would also be desirable to provide shutter capability to the aforementioned lens, or to any antenna, for use in control of antenna radar cross section and/or protection from antenna damage caused by incident high-power radio frequency signals.

SUMMARY OF THE INVENTION

In accordance with the present invention, a frequency selective surface (FSS) that can be electrically detuned to provide insertion phase and amplitude control of radio frequency radiation propagating through the structure is provided. In general, the present invention uses frequency selective surfaces that are locally detuned in order to control the localized admittance, and hence localized insertion phase, of each surface. Further, a method for implementing such localized de-tuning, and hence localized insertion phase control, is described wherein two or three tightly coupled frequency selective surfaces are separated from one another by a small distance that can be electro-mechanically altered. By cascading a sufficient number of individually controllable tightly coupled groups of such surfaces, a full 360 degree change in insertion phase can be produced through the aggregate of surfaces, which is sufficient to scan the beam of a fixed beam antenna that transmits or receives through them. The same detuning technique when applied globally to an FSS can be used to increase or decrease the transmission amplitude of the FSS, thereby producing the effect of a shutter within a fixed frequency band.

In accordance with an embodiment of the present invention, an electromechanically reconfigurable microwave lens is provided that uses frequency selective surfaces in conjunction with polyimide macro-electromechanical systems (PMEMS). The following embodiment describes a two-layer implementation. According to such an embodiment, a first FSS sheet comprising a first array of unit cells formed on a first surface is provided. A second FSS sheet comprising a second array of unit cells is formed on a second surface, positioned so that the first and second arrays occupy parallel planes and at least partially overlap. In accordance with an embodiment of the present invention, the unit cells consist of slots configured to form rectangles in a conductive layer. The rectangular cells of the first array may be registered with the rectangular cells of the second array, such that a plurality of the cells in the first array each have a corresponding cell in the second array. In addition, the unit cells of the first array may differ in their dimensions from the unit cells of the second array. According to still another embodiment of the present invention, the unit cells of the first array are registered with the unit cells of the second array such that the plurality of unit cells of the first array each have at least one edge that is not aligned with at least one edge of a corresponding unit cell of the second array. By changing the distance separating the first and second arrays of unit cells, the admittance of the lens can be controlled. This in turn allows the phase of radio frequency radiation propagating through the lens to be controlled.

According to an embodiment of the present invention, the distance between the first and second arrays is controlled by selectively introducing a voltage potential between the first and second arrays. In particular, by introducing a voltage differential between the first and second arrays, the surfaces of the arrays may be pulled closer to one another, thereby altering the admittance presented by the lens to an incident radio frequency wave. Upon removal of the voltage differential, an elastic force may return the distance between the arrays to a nominal distance. Such an elastic force may be provided by the deformation of at least a portion of a flexible substrate upon which at least one of the arrays is formed. Alternatively or in addition, the distance between the arrays may be restored to a nominal distance by introducing a potential difference between either the first array or the second array and a third surface.

In accordance with an embodiment of the present invention, a method is provided for steering a radio frequency electromagnetic wave. According to the method, a lens having reconfigurable frequency selective surfaces is positioned so that at least a portion of the electromagnetic wave that is to be modified is incident on the lens. The amount of phase shift imparted to the incident radiation is altered between at least first and second amounts by altering the distance between two frequency selective surfaces. In accordance with an embodiment of the present invention, this distance is altered by electro-mechanical means. In accordance with a further embodiment of the present invention, the distance between the two frequency selective surfaces is altered by introducing a voltage potential between the two frequency selective surfaces, or between one of the frequency selective surfaces and another surface.

In accordance with still another embodiment of the present invention, the unit cells of at least one of the frequency selective surfaces are divided into rows or columns such that the electrically conductive material surrounding a first of the rows or columns is electrically isolated from the electrically conductive material surrounding the adjacent rows or columns. According to such an embodiment, the phase shift imparted to incident electromagnetic radiation by one portion of the reconfigurable lens can be different from the phase shift imparted by other areas of the lens.

In accordance with still another embodiment of the present invention, a lens having a plurality of frequency selective surface pairs is provided. Within each pair, at least one of the frequency selective surfaces has columns or rows of unit cells that are electrically isolated from and movable in relation to adjacent columns or rows and that are moveable to the other frequency selective surface in the pair. According to such an embodiment, a plurality of phase shift amounts may be imparted by the reconfigurable lens to different portions of an incident electromagnetic wave. For example, the lens may be controlled to impart an ascending sequence of phase shift amounts across the width of the lens, to steer the incident electromagnetic radiation wave in a first dimension.

According to still another embodiment of the present invention, a plurality of frequency selective surfaces having columns of unit cells isolated from adjacent columns of unit cells are provided to steer an incident electromagnetic wave in a first dimension. In addition, a second plurality of frequency selective surfaces, having rows of unit cells electrically and mechanically isolated from adjacent rows of unit cells are provided to phase shift an incident electromagnetic wave in a second dimension. The frequency selective surfaces having their unit cells divided into columns are aligned with the frequency selective surfaces having their unit cells divided into rows such that the rows and columns are orthogonal to one another. The resulting reconfigurable lens assembly is capable of scanning radio frequency radiation incident on the lens in two dimensions.

According to yet another embodiment of the present invention, a reconfigurable radio frequency lens is provided by arranging a pair of frequency selective surfaces. Within each pair at least one of the frequency selective surfaces has rows or columns of unit cells that can be selectively moved so that a distance between the rows or columns of unit cells from the other surface can be altered to provide a selected phase shift amount. Furthermore, a plurality of pairs of frequency selective surfaces can be cascaded with one another to provide a lens capable of shifting incident radio frequency radiation by a plurality of phase shift amounts. If the cascaded FSS pairs both have columns (or rows) of unit cells that can be moved, all or a portion of an incident radio frequency wave can be steered in one dimension. If one of the FSS pairs has columns of unit cells that can be moved, and another of the FSS pairs has rows of unit cells that can be moved, an incident radio frequency wave can be steered in two dimensions.

According to a further embodiment of the present invention, a pair of FSS surfaces is capable of phase shifting at least a portion of incident radio frequency radiation by either of two amounts. Such a pair of FSS surfaces therefore forms a 1-bit lens. Multiple 1-bit lenses can be cascaded with one another to form a multiple bit lens.

According to still another embodiment of the present invention, a radio frequency lens or shutter may be provided by cascading surfaces or stages having resonant frequencies that can be altered or tuned. For example, surfaces with resonant frequencies that can be tuned using diodes or a tunable ferroelectric may be cascaded to provide a lens or shutter.

According to yet another embodiment of the present invention, a radio frequency shutter may be produced, wherein the amplitude of transmitted radio frequency waves through one or more pairs of FSS structures may be increased or decreased within a fixed frequency band. This is accomplished by de-tuning the FSS pair or pairs from a low loss resonant state to a higher loss non-resonant state.

Based on the foregoing summary, a number of salient features of the present invention are readily discerned. A reconfigurable radio frequency lens or shutter can be provided using pairs of frequency selective surfaces. Radio frequency radiation incident on the lens can be selectively phase shifted by altering the distance between the two frequency selective surfaces. Selected portions of the incident radio frequency wave can be phase shifted by controlling the distance separating individual rows or columns of unit cells of a first frequency selective surface from corresponding rows or columns of unit cells of a second frequency selective surface. The distance between the frequency selective surfaces of a pair of such surfaces can be controlled by applying a voltage potential between the two frequency selective surfaces or portions of those surfaces. By cascading multiple pairs of frequency selective surfaces together, a multiple bit reconfigurable radio frequency lens capable of pointing an incident beam of electromagnetic energy in space is provided. The reconfigurable lens features low insertion losses, and relatively simple construction and control techniques.

Additional advantages of the present invention will become readily apparent from the following discussion, particularly when taken together with the accompanying drawings.

DETAILED DESCRIPTION

The present invention is directed to reconfigurable and electro-mechanically reconfigurable radio frequency lenses.

Figure 2:
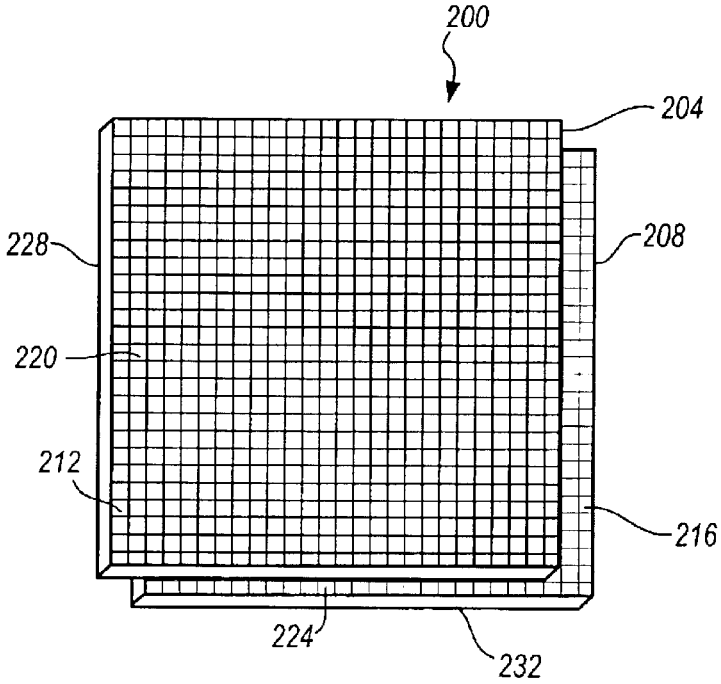
FIG. 2 illustrates a reconfigurable lens formed from a pair of overlapping band pass frequency selective surface sheets in accordance with an embodiment of the present invention.

With reference now to FIG. 2, a reconfigurable radio frequency lens 200 in accordance with an embodiment of the present invention is illustrated. The lens 200 generally includes first 204 and second 208 frequency selective surface (FSS) sheets. Each of the FSS sheets 204 and 208 includes an array of unit cells 212 and 216. In accordance with an embodiment of the present invention, the unit cells 212 of the first sheet 204 are a different size than the unit cells 216 of the second FSS sheet 208. According to such an embodiment, the first FSS sheet 204 is aligned so that each of its unit cells 212 overlays and is centered with respect to a corresponding unit cell 216 of the second FSS sheet 208.

According to another embodiment of the present invention, the unit cells 212 and 216 are the same size as one another. However, the first FSS sheet 204 is aligned with respect to the second FSS sheet 208 such that there is a registration offset between the edges of the unit cells 212 of the first FSS sheet 204 and the edges of the unit cells 216 of the second FSS sheet 208. According to still another embodiment of the present invention, the dimensions of the unit cells 212 of the first FSS sheet 204 are different from the dimensions of the unit cells 216 of the second FSS sheet 208, and the FSS sheets 204 and 208 are aligned such that the unit cells 212 of the first FSS sheet 204 are not centered with respect to the unit cells 216 of the second FSS sheet 208.

The FSS sheets 204 and 208 generally include an electrically conductive layer 220, 224 supported by a dielectric substrate 228, 232. For example, the electrically conductive layers 220, 224 of the FSS sheets 204 and 208 may be formed from a metal foil, and the substrate 228, 232 from a flexible dielectric material, such as a polyimide. The patterning of the electrically conductive layers 220, 224 may be performed using known techniques, including printed circuit board manufacturing techniques. Such techniques may involve additive or subtractive processes, including chemical deposition, and mechanical or chemical etching.

Figure 3:
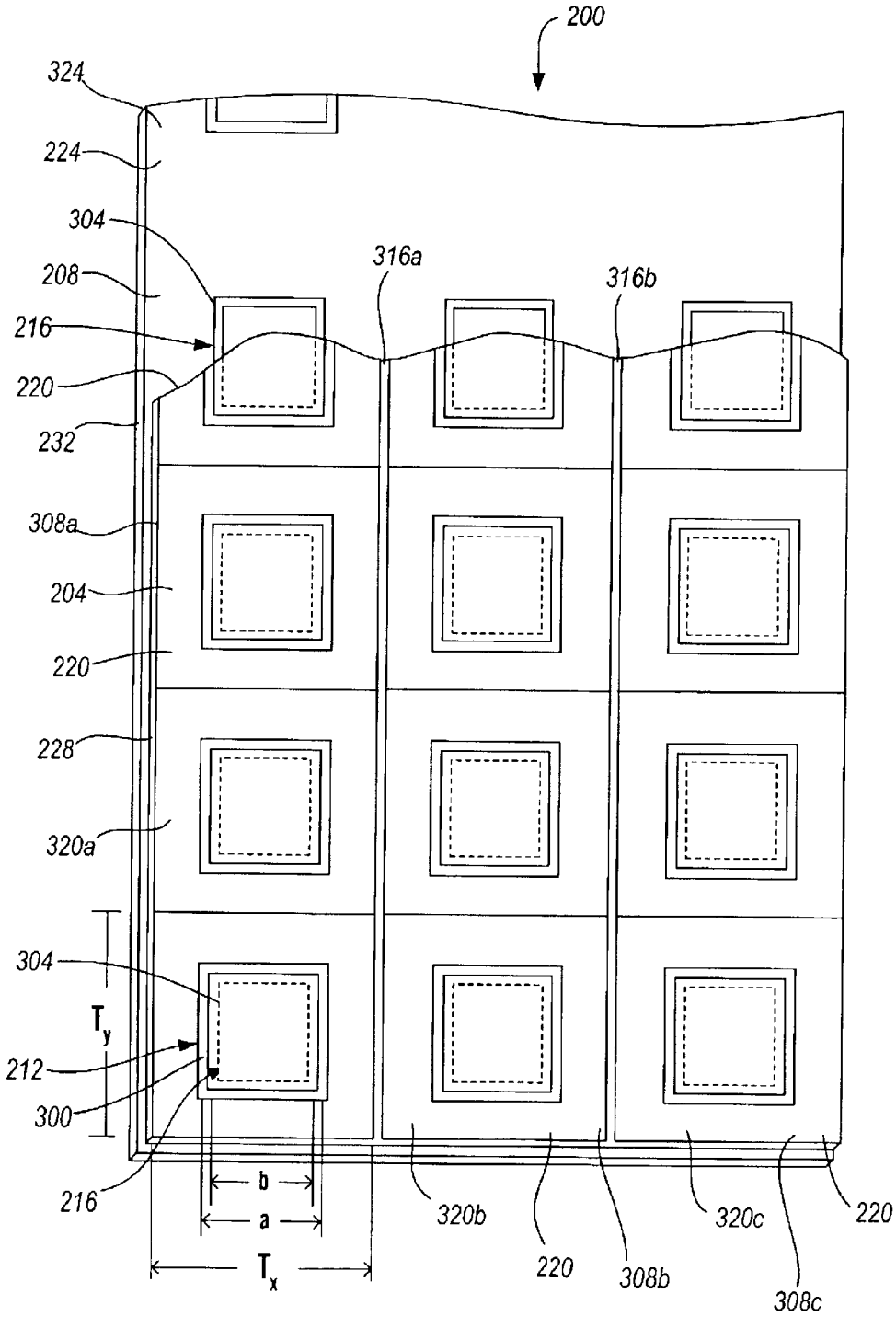
FIG. 3 is a perspective view of a portion of a reconfigurable lens formed from a pair of frequency selective surfaces in accordance with an embodiment of the present invention.

With reference now to FIG. 3, a plurality of unit cells 212 of the first FSS sheet 204 are shown. From FIG. 3 it can be appreciated that each of the unit cells 212 of the first FSS sheet 204 overlap a corresponding unit cell 216 of the second FSS sheet 208. In general, the unit cells 212 of the first FSS sheet 204 each comprise a rectangular arrangement of slots 300 formed in the layer of electrically conductive material. The slots 300 have a width w and a length a. The unit cells 216 of the second FSS sheet 208 similarly comprise a rectangular arrangement of slots 304 formed in the electrically conductive layer 224 of the second FSS sheet 208. The slots 304 have a width w and a length b. Because the length a of the sides of the unit cells 212 of the first FSS sheet 204 are different from the length b of the unit cells 216 of the second FSS sheet 208, it can be appreciated that at least some of the sides of the unit cells 212 and 216 are misaligned with respect to one another.

Figure 4:
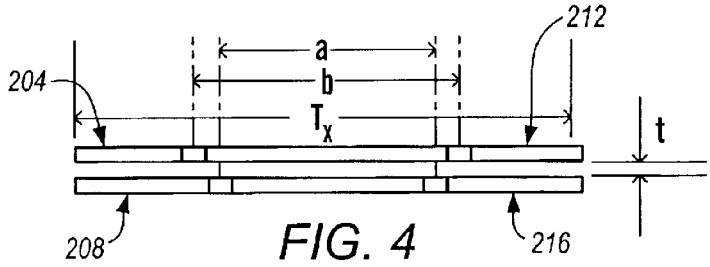
FIG. 4 is a cross-section of a pair of opposed frequency selective surface unit cells in accordance with an embodiment of the present invention.

With reference now to FIG. 4, a pair of unit cells 212 and 216 such as are illustrated in FIG. 3 are shown in cross section. In FIG. 4 it is apparent that the first FSS sheet 204 is separated from the second FSS sheet 208 by a distance t. By varying the distance t separating the unit cells 212 and 216 of the first 204 and second 208 FSS sheets, the susceptance presented by the lens 200 to incident radio frequency radiation can be altered, as will be explained in greater detail below. This in turn allows the phase delay of such radiation to be selectively altered. As can be appreciated by one of skill in the art, by altering the phase delay imparted to a radio frequency wave or radiation in a coordinated fashion, the radiation can be pointed in space.

With continued reference to FIG. 3, it can be appreciated that the unit cells 212 of the first FSS sheet 204 are arrayed in independent columns 308. In particular, gaps 316 are formed in the electrically conductive layer 220 surrounding the slots 300 of the unit cells 212 of the first FSS sheet 204. The gaps 316 form columns of contiguous electrically conductive material 320 that are electrically isolated from adjacent columns of electrically conductive material 320. The division of the electrically conductive layer 220 into columns 320 by gaps 316 allows different voltages to be placed on the columns of electrically conductive material 320 associated with different columns of unit cells 308. By placing an electrical charge on a column of electrically conductive material 320 associated with a column 308 of unit cells, that column of unit cells 308 can be drawn towards the second FSS sheet 208. That is, the distance t (see FIG. 4) between that column of unit cells 308 and the corresponding unit cells 216 can be decreased. It will be noted that in FIG. 3, the conductive layer 224 of the second FSS sheet 208 need not be divided into columns, leaving an electrically contiguous area 324. As a result, the distance t between a column of unit cells 308 on the first FSS sheet 204 and the second FSS sheet 208 can be altered by altering the electrical potential provided to the columns of electrically conductive material 320 surrounding the column of unit cells 308 that is to be moved, while maintaining a selected voltage across the electrically contiguous area 324 of the second FSS sheet 208.

In accordance with an embodiment of the present invention, the gaps 316 between columns of unit cells 308 are formed only in the conductive layer 220. According to such an embodiment, relative movement between adjacent columns of unit cells 308 may be provided by the flexibility of the substrate 228. According to an alternative embodiment, the gaps 316 can extend through the substrate 228 along all or a portion of the length of the columns of unit cells 308 to allow for the independent movement of adjacent columns 308.

Figure 5A:
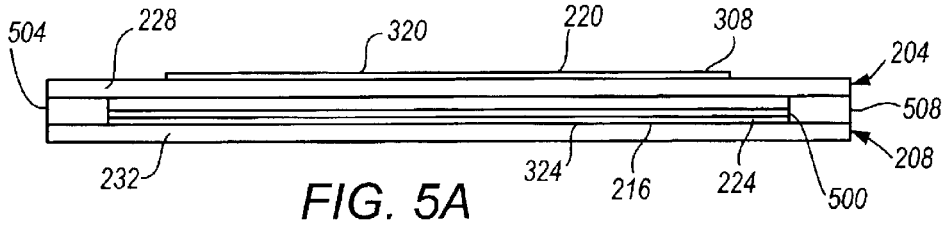
FIG. 5A is a cross-section of a column of opposed frequency selective surface unit cells in accordance with an embodiment of the present invention in a first position.
Figure 5B:
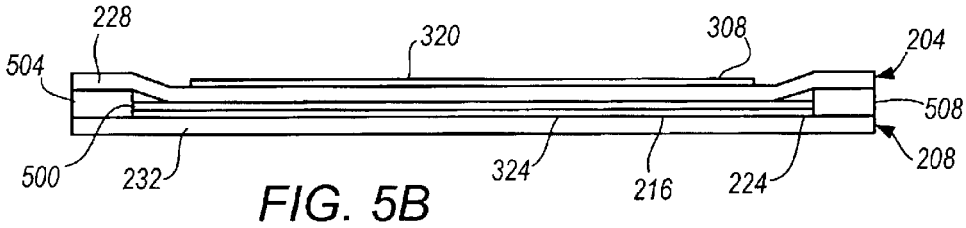
FIG. 5B is a cross-section of a column of opposed frequency selective surface unit cells in accordance with an embodiment of the present invention in a second position.

With reference now to FIGS. 5A and 5B, cross sections of a column of unit cells 308 are illustrated. In particular, FIG. 5A illustrates the column of unit cells 308 in a first position, with the distance between the FSS 204, 208 sheets equal to $t_1$. FIG. 5B illustrates the column of unit cells 308 in a second position, with the distance between FSS sheets 204, 208 equal to $t_2$. In the embodiment illustrated in FIGS. 5A and 5B, the substrate 228 on which the column of unit cells 308 is formed is a flexible polyimide material. The flexibility of the substrate 228 allows the column of cells 308 to move from the first position (FIG. 5A) to the second position (FIG. 5B) when an attractive voltage potential is established between the column of electrically conductive material 320 associated with the column of unit cells 308 and the electrically conductive layer 224 surrounding the unit cells 216 of the second FSS sheet 208. A spacer layer 500 may be interposed between the first 204 and second 208 FSS sheets to maintain the desired distance $t_2$ between the column of unit cells 308 and the unit cells 216 of the second FSS sheet 208 when the column of unit cells 308 is in the second position.

After the attractive potential difference between the column of electrically conductive material 320 associated with the column of unit cells 308 and the electrically contiguous area 324 of the second FSS sheet 208 has been removed, the column of unit cells 308 returns to the first position as a result of the elasticity of the flexible substrate 228. In accordance with another embodiment of the present invention, the return of the column of unit cells 308 to the first position may be assisted by establishing a voltage potential between the column of unit cells 308 and an electrode positioned on a side of the column of unit cells 308 opposite the second FSS sheet 208. The distance $t_1$ between the column of unit cells 308 and the second FSS sheet 208 when the column of unit cells 308 is in the first position may be maintained by first 504 and second 508 spacer blocks positioned at the top and bottom of the column of unit cells 308, respectively.

Figure 6A:
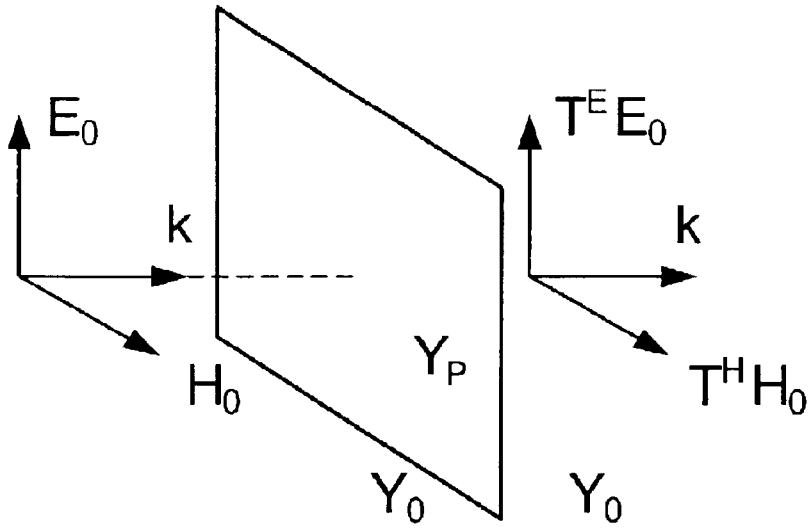
FIG. 6A illustrates the effect of an admittance surface on an incident electromagnetic wave.
Figure 6B:
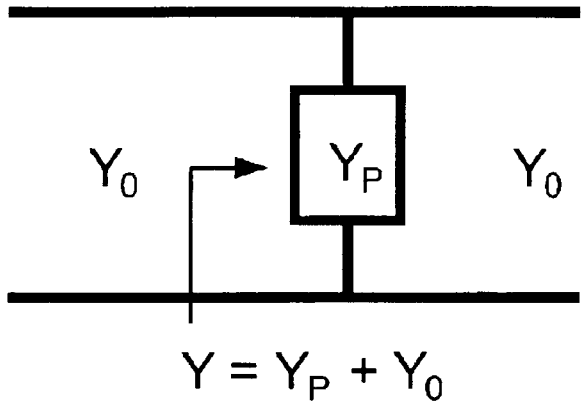
FIG. 6B illustrates a circuit representation of an admittance surface.

A reconfigurable microwave lens in accordance with the present invention controls the phase of a transmitted plane wave by altering the admittance presented to the wave as compared to the admittance of free space. In FIG. 6A, the admittance encountered by a transmitted plane wave as it passes from free space, through the admittance surface presented by the reconfigurable lens of the present invention, and back into free space, is illustrated. The network equivalent of the arrangement illustrated in FIG. 6A is shown in FIG. 6B. By analogy to the network model, the amplitude and phase of the transmitted plane wave is the amplitude and phase of the complex transmission coefficient T. T is given, along with its associated reflection coefficient Γ, by the following simple network expressions:

$$T = \frac{2Y_0}{Y_0 + Y'}\Gamma = \frac{Y_0 - Y}{Y_0 + Y'} \text{ where } T = 1 + \Gamma$$

From this expression, it will be noted that perfect transmission ($|T|=1$), occurs when $Y=Y_0$, or equivalently when $Y_p=0$, which is the desired result for a lens. If the admittance surface (i.e., the lens) is assumed to have very low dissipative loss, then $Y_p$ can be approximated to be completely imaginary and represented by only a susceptance term, B, so that $Y_p=jB$. Under these conditions, a very simple expression for the transmission phase (i.e., the phase shift during transmission) results:

$$\angle T = \tan^{-1}\left(\frac{-B}{2Y_0}\right)$$

By manipulating the susceptance term, B, the transmission phase through the surface can be controlled, with an associated change in transmission amplitude.

As noted above, a simple band pass FSS consists of a periodic array of square loop slots etched in a thin conducting film. The slots behave in the same fashion as a resonant L-C shunt admittance pair for which the resonant frequency occurs when $$\omega^2 = \frac{1}{LC}.$$

For this case, $$Y_p = jB = j\left(\omega C - \frac{1}{\omega L}\right).$$

Figure 1B:
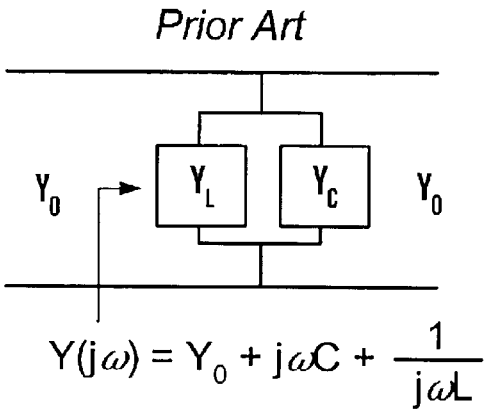
FIG. 1B illustrates an equivalent circuit for a band pass frequency selective surface in accordance with the prior art.
Figure 1A:
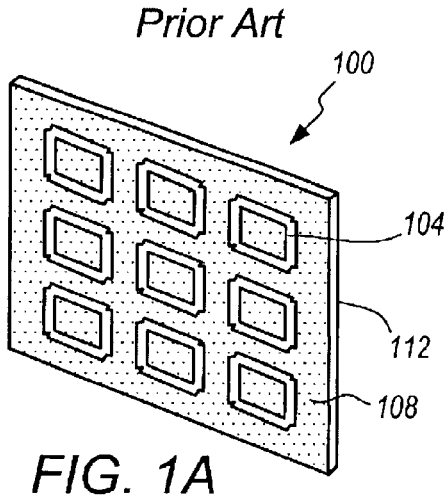
FIG. 1A illustrates a band pass frequency selective surface in accordance with the prior art.

In order to manipulate the value of B for a band pass structure such as the one illustrated in FIG. 1, the nominal constants C and/or L must be made dependent variables. The inventors of the present invention have recognized that this can be accomplished by cascading two FSS layers together, with a very small air gap separation, for example as shown in FIGS. 2, 3 and 4. The separation is much smaller than the dimensions of the unit cell and is of the same order of magnitude as the loop slot widths. If the size dimensions of the unit cells of the upper and lower FSS layers are made slightly different, or they are misaligned with one another (i.e., there is a registration offset), the value of the now dependent variables C(t) and L(t) are increased, as the two FSS surfaces are brought together. This effectively pulls the resonant frequency $$\omega = \frac{1}{\sqrt{LC}}$$

down and causes an increased delay in transmission phase. Accordingly, altering the separation between such FSS sheets allows the transmission phase shift imparted to an incident radio frequency wave to be altered. In addition, altering the separation between FSS sheets can be used to modulate the transmission amplitude of a radio frequency wave or radiator. Accordingly, a shutter effect may be provided with the shutter presenting a minimal or low transmission loss when it is in an open state, and a maximum or high transmission loss when it is in a closed or de-tuned state.

In accordance with an embodiment of the present invention, the length of the slots 300 (dimension a in FIGS. 3 and 4 ) of the unit cells 212 of the first FSS sheet 204 is 0.073 inch. The length of the slots 304 (dimension b in FIGS. 3 and 4 ) of the unit cells 216 of the second FSS sheet 208 is 0.066 inch. The dimensions of the conductive material 312 and 324 surrounding each unit cell 212 and 216 (dimensions $T_X$ and $T_Y$ in FIG. 3) is 0.091 inch. The width w of the slots is 0.005 inch. The distance t between the first and second FSS sheets 204 and 208 may be varied from about 0.008 inch to about 0.002 inch. The distance between the electrically conductive layers 220, 224 may be varied from about 0.0009 to about 0.003 (e.g., where the substrate 228 is 0.001 inch thick).

Figure 7A:
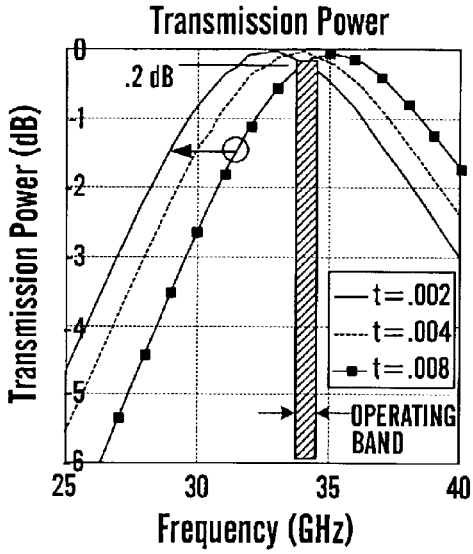
FIG. 7A is a graph depicting the transmission amplitude of radio frequency radiation incident on a one bit reconfigurable lens in accordance with an embodiment of the present invention.
Figure 7B:
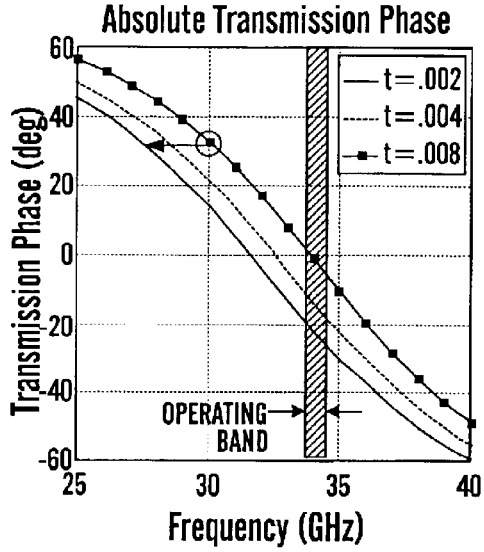
FIG. 7B is a graph depicting the absolute transmission phase shift imparted to radio frequency radiation incident on a one bit reconfigurable radio frequency lens in accordance with an embodiment of the present invention.

With reference now to FIGS. 7A and 7B, the effect of altering the distance t on the transmission amplitude and phase performance of a millimeter wave band pass lens 200 having the dimensions set forth in the example above is illustrated. In particular, with reference to FIG. 7A, when the distance t between the first and second FSS sheets 204 and 208 is reduced from 0.008 inch to 0.002 inch, the resonance frequency of the device shifts from 35 GHz to 33 GHz. This represents about a 6% shift in resonance frequency. However, the fixed operational frequency band for which the transmission losses are maintained at a low level (i.e., <0.2 dB) is less than 2%. The transmission phase shift that occurs for this case, is illustrated in FIG. 7B.

Figure 7C:
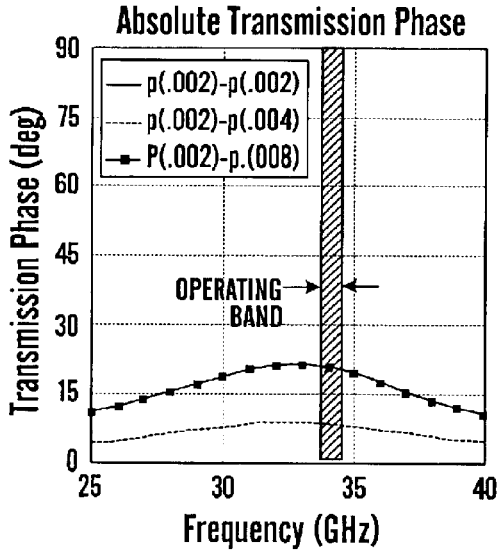
FIG. 7C is a perspective depicting the relative transmission phase shift of radio frequency radiation incident on a one bit reconfigurable radio frequency lens in accordance with an embodiment of the present invention.

The relative phase shift from one state to another, and not the absolute phase, is important for successful lens operation. In FIG. 7C, the phase data illustrated in FIG. 7B has been normalized relative to the t=0.002 inch state. FIG. 7C illustrates that a phase shift of approximately 22° is achieved for the example lens in accordance with the present invention while maintaining a low loss (about 2%) over the operational bandwidth.

In general, a reconfigurable lens 200 having two FSS sheets 204, 208 and in which the distance t between those sheets is variable between first and second amounts, can be considered a 1 bit device. This is because such a device is capable of shifting incident radio frequency radiation by either first or second amounts. In order to provide additional phase shift amounts, a lens 200 in which the distance t can have more than two states may be provided. Alternatively, a series of lenses or stages 200 can be cascaded together.

Figure 8:
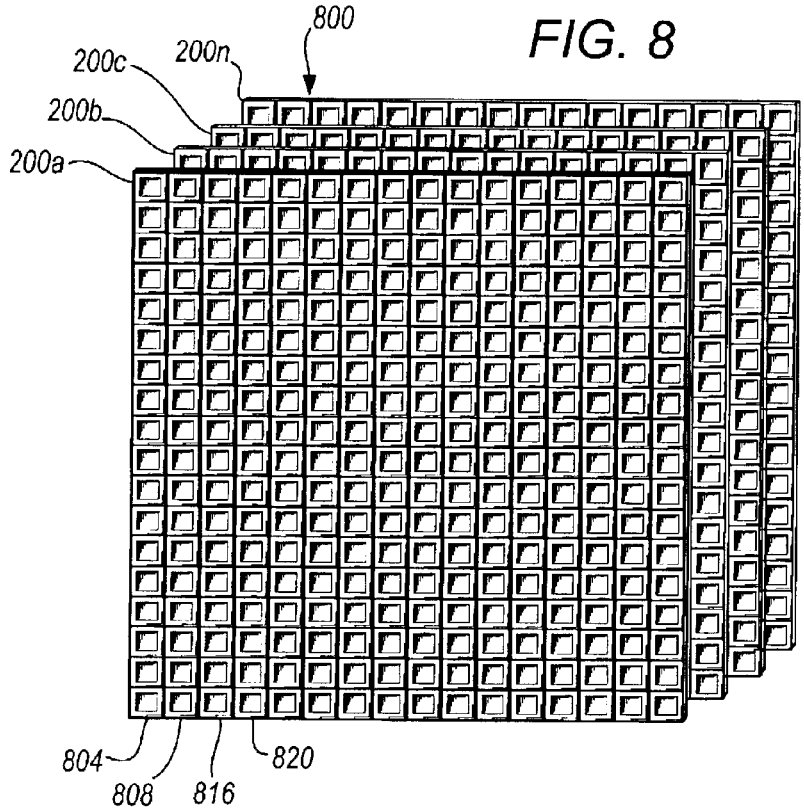
FIG. 8 is a perspective view of a multiple bit one dimensional reconfigurable radio frequency lens in accordance with an embodiment of the present invention.

A multiple bit reconfigurable lens 800 is depicted in FIG. 8. In general, the multiple bit reconfigurable lens 800 includes a plurality of 1 bit lenses 200 cascaded together. In the device illustrated in FIG. 7, the columns 308 of unit cells 212 are electrically isolated from one another. Accordingly, the distance t between any column 308 of unit cells 212 from the adjacent unit cells 216 within a 1 bit lens 200 can be separately controlled. This in turn allows a desired phase taper across all or a portion of the width of the multiple bit reconfigurable lens 700 to be achieved.

For example, the first column 804 in each of the 1-bit lenses 200 included in the multiple bit lens assembly 700 can have a voltage applied so that the distance is small (e.g., t=0.002 inch). When in this position, no relative transmission phase shift is imparted to an incident radio frequency wave. With respect to the second columns 808, the first and second 1-bit lenses 200*a* and 200*b* can have a voltage applied to that column such that the distance t with respect to those columns 808 is reduced, and the second column 808 of the third lens 200*c* can have no voltage applied, so that the distance t is relatively large (e.g., t=0.008 inch). So configured, the second columns 808 will impart a first relative phase shift amount to an incident radio frequency wave. The third columns 816 can be set to impart a second relative phase shift amount. This can be accomplished by applying a voltage to set the distance t for the third column 816 of the first lens 200*a* at a small value, while applying no voltage to the third columns 816 of the second 200*b* and third 200*c* lenses so that t is relatively large. The fourth columns 820 can be set to impart a third relative phase shift amount by applying no voltage, so that the distance t is relatively large in all of the lenses 200.

From the foregoing example, it can be appreciated that by allowing for the separate control of columns of unit cells, a multiple bit reconfigurable lens 800 is capable of providing a tapered phase shift across at least a portion of the width of the lens 800. Accordingly, an incident radio frequency wave can be pointed in a first dimension. Because the effect of cascading individual lenses 200 is cumulative, a large number of such lenses may be utilized to achieve a desired phase taper and amount. If each lens 200 of a multiple-bit lens 800 is capable of shifting an incident radio frequency wave by the same amount, an n-bit lens 800 has n+1 phase shift amounts available. Where each one-bit lens 200 of a multiple-bit lens 800 is capable of phase shifting an incident radio frequency wave by first or second amounts that are different from any other lens 200, $2^n$ phase shift amounts are available.

Figure 9:
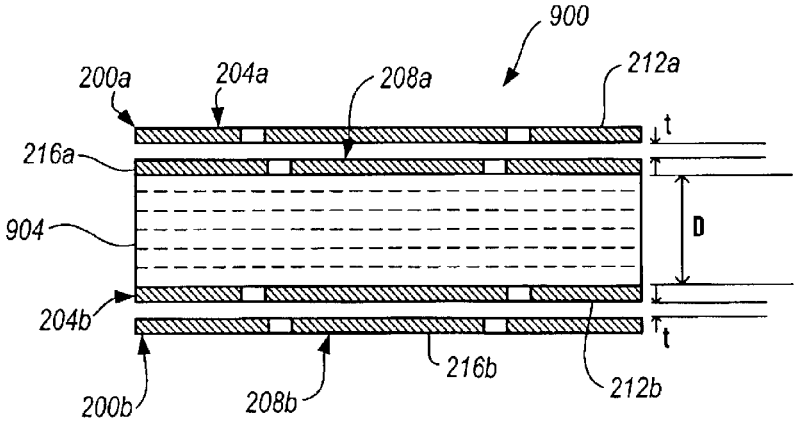
FIG. 9 is a cross-section of a portion of a two bit reconfigurable radio frequency lens in accordance with an embodiment of the present invention.

With reference now to FIG. 9, a partial cross-section of a 2 bit reconfigurable lens 900 is illustrated. As shown in FIG. 9, a first I bit reconfigurable lens 200*a* overlays a second 1 bit reconfigurable lens 200*b*. The first 200*a* and second 200*b* 1 bit lenses are separated from one another by a dielectric material 904, having a thickness D. Where the dimensions of the unit cells 212 and 216 are as given in the example set forth above, the distance D separating the adjacent surfaces of the 1 bit lenses 200 may be about 0.08 inch. In general, the distance D is approximately equal to one quarter of the wavelength of the operating frequency (i.e. the frequency of the incident radiation). The first 200*a* and second 200*b* 1 bit lenses can be identical to one another. That is, each 1 bit lens 200 may have the same number of unit cells, and the dimensions of the unit cells 212 of the first FSS sheet 204*a* may be the same as the unit cells 212*b* of the first FSS sheet 204*b* of the second lens 200*b*. Likewise, the unit cells 216*a* on the second FSS sheet 208*a* of the first lens 200*a* may have the same dimensions as the unit cells 216*b* of the second FSS sheet 208*b* of the second lens 200*b*.

Figure 10B:
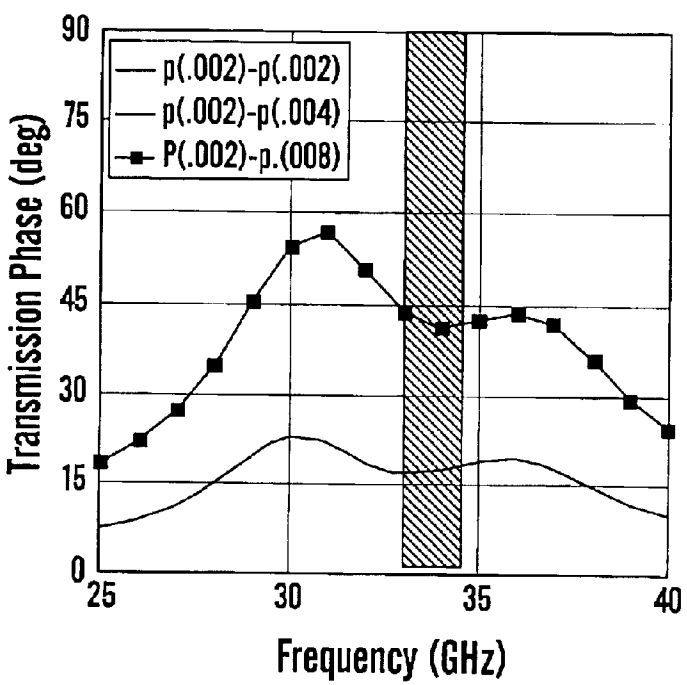
FIG. 10B is a graph depicting the relative transmission phase shift of radio frequency radiation incident on a two bit reconfigurable radio frequency lens in accordance with an embodiment of the present invention.
Figure 10A:
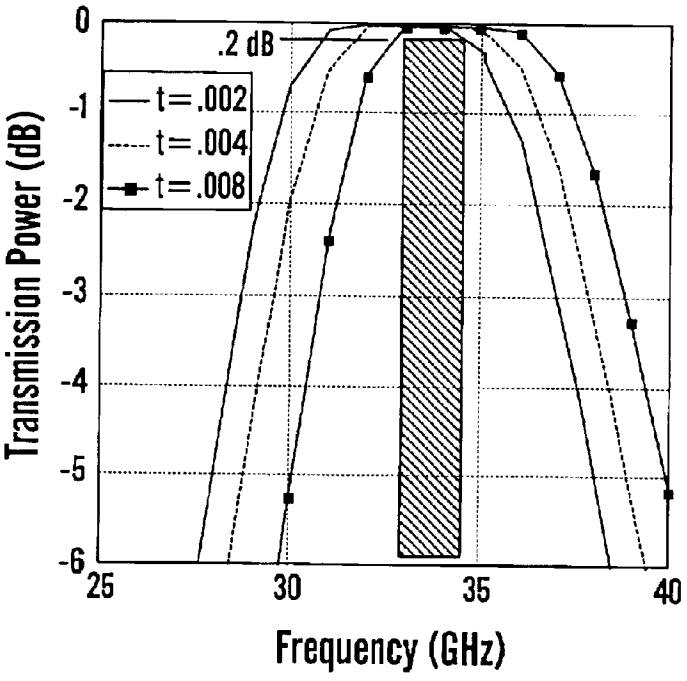
FIG. 10A is a graph depicting the amplitude of radio frequency radiation incident on a two bit reconfigurable radio frequency lens in accordance with an embodiment of the present invention.

With reference now to FIGS. 10A and 10B, the transmission power and relative transmission phase of radio frequency radiation passing through a 2 bit reconfigurable lens 900 in accordance with the present invention are illustrated. The cascading of individual 1 bit lenses 200*a* and 200*b* to form a 2 bit lens 900 results in a device having a larger operational bandwidth at less than 0.2 dB loss. In particular, the operational bandwidth of the 2 bit lens 900 is approximately 6%. In addition, FIG. 10B illustrates that the 2 bit reconfigurable lens 900 is capable of producing a phase shift of greater than about 40° within the operational bandwidth.

Figure 11:
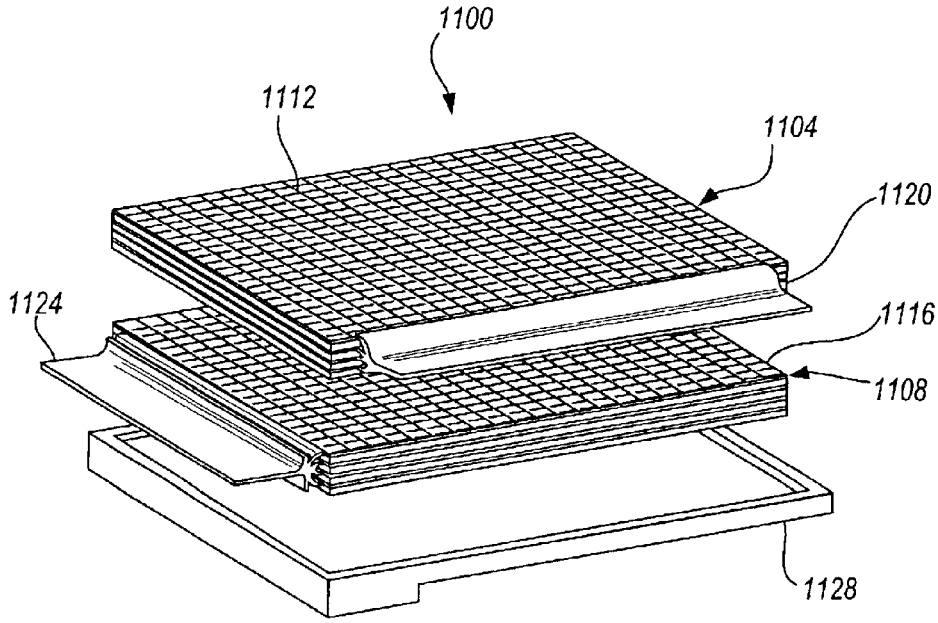
FIG. 11 is a perspective view of a multiple bit two dimensional reconfigurable radio frequency lens in accordance with an embodiment of the present invention.

In order to provide a reconfigurable lens capable of scanning radio frequency radiation in two dimensions, a lens having individually controllable columns of unit cells may be cascaded with a lens having individually controllable rows of unit cells. With reference now to FIG. 11, a reconfigurable lens 1100 capable of scanning incident radio frequency radiation in two dimensions is illustrated. In general, the reconfigurable lens 1100 includes a first multiple bit lens 1104 and a second multiple bit lens 1108. The first multiple bit lens 1104 includes columns 1112 of unit cells that can be individually controlled. The second multiple bit reconfigurable lens 1108 includes rows 1116 of unit cells that can be individually controlled. By cascading the first 1104 and second 1108 multiple bit lenses with one another such that the columns 1112 of the first lens 1104 are orthogonal to the rows 1116 of the second lens 1108, incident radio frequency radiation can be scanned in two dimensions.

The control of individual columns 1112 may be accomplished by providing a dedicated signal line to each column 1112 through a first edge mounted connector 1120. The rows 1116 of the second lens 1108 may each be provided with a signal line through a second edge mounted connector 1124. In general, a signal line is provided for each row or column of each pair of frequency selective surfaces in the lens 1100. As shown in FIG. 11, the lens 1100 is positioned so that radio frequency radiation emitted by an antenna radiator structure 1128 passes through the lens 1100.

Figure 12:
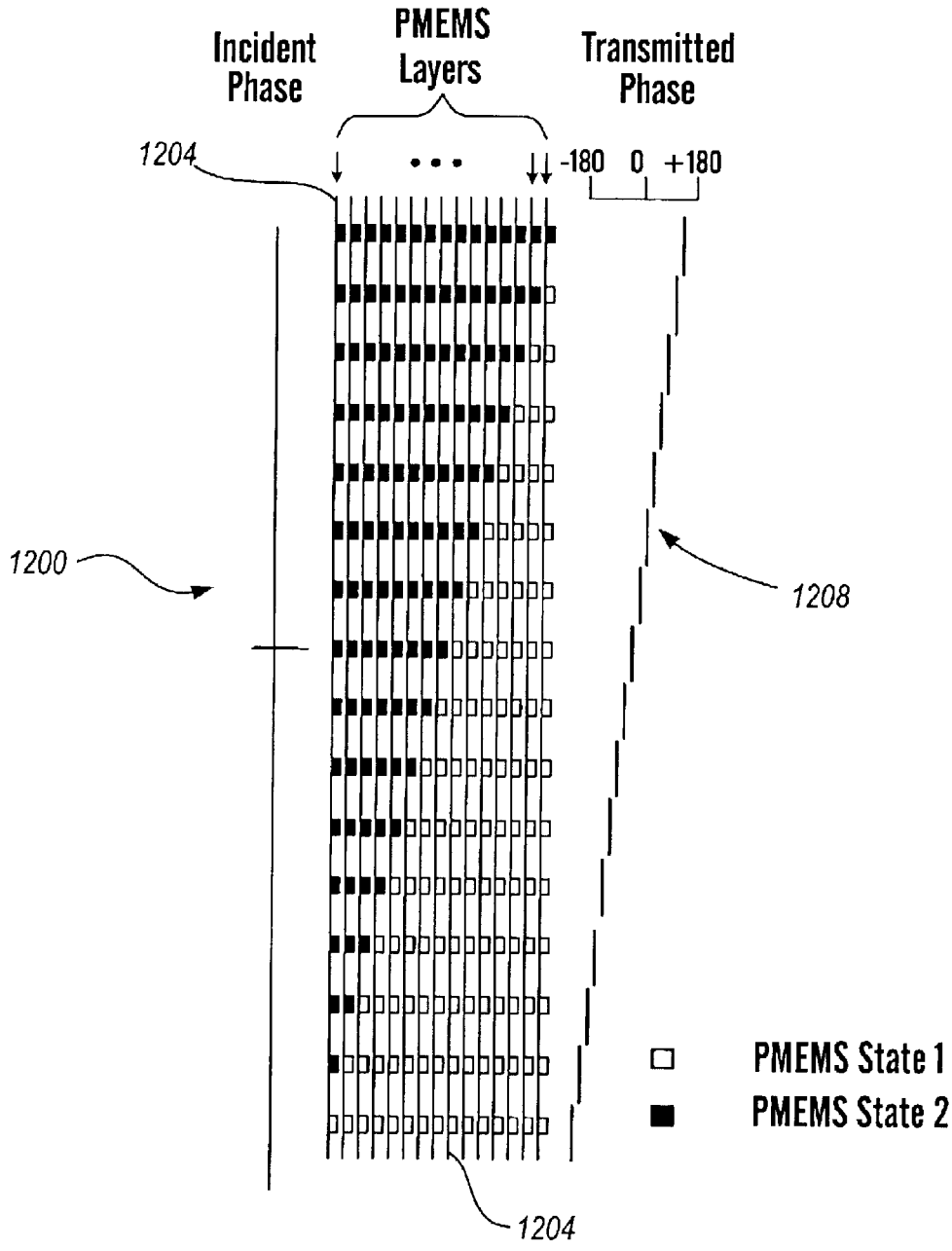
FIG. 12 is a schematic representation of a one-dimensional scanning lens and the transmitted signal phase in accordance with an embodiment of the present invention.

With reference now to FIG. 12, a one-dimensional multiple bit scanning lens 1200 in accordance with an embodiment of the present invention is represented schematically. The lens 1200 is comprised of multiple pairs or stages of frequency selective surfaces, each forming a 1-bit lens 1204, having individually controllable rows of unit cells. As shown in FIG. 12, each row of each pair of frequency selective surfaces may be in either a first or a second state. By configuring the lens 1200 as shown in FIG. 12, the transmitted phase of a radio frequency signal may be tapered. Furthermore, the phase may be tapered through 360°, as shown by the transmitted phase 1204 depicted in FIG. 12.

Figure 13B:
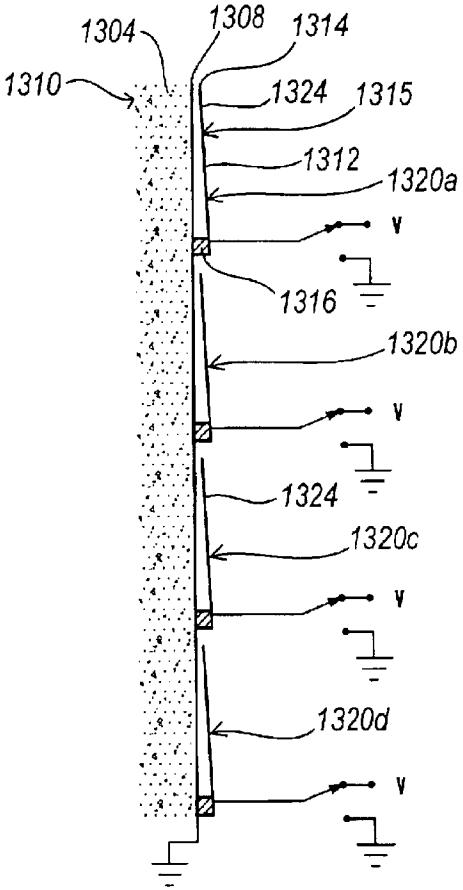
FIG. 13B is a cross-section of the non-symmetric reconfigurable lens of FIG. 13A, with elements in a second position.
Figure 13A:
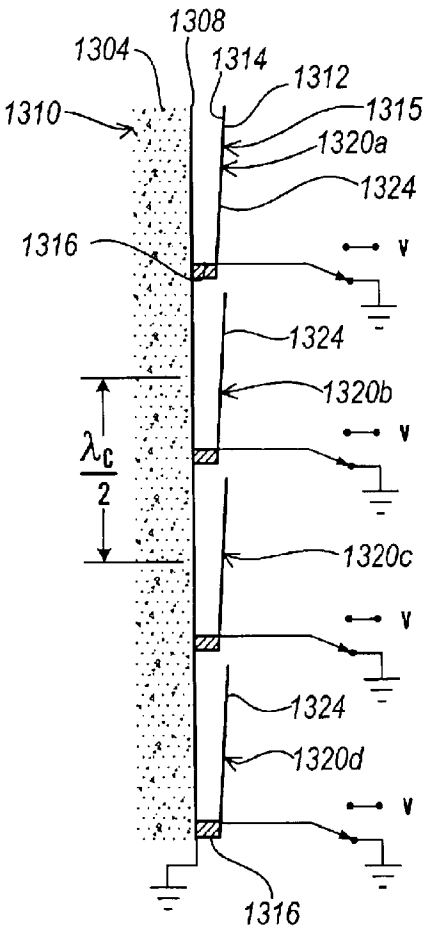
FIG. 13A is a cross-section of a non-symmetric reconfigurable lens in accordance with an embodiment of the present invention, with elements in a first position.

FIGS. 13A-B and 14A-C illustrate non-symmetric and symmetric forms of reconfigurable lenses formed using FSS/PMEMS surfaces. The non-symmetric form shown in FIGS. 13A and 13B, employs a single rigid substrate 1304 onto which a first conducting FSS layer 1308 is deposited to form a first FSS sheet 1310. A second conducting FSS layer 1312 is deposited on a thin flexible substrate 1314 to form a second FSS sheet 1315, and is attached to the first FSS sheet 1310 with periodic spacers 1316. The embodiment of the second FSS sheet 1315 illustrated in FIGS. 13A and 13B is pattern-cut to facilitate flexure. When zero electric potential difference is applied between the rigid conducting FSS layer 1304 and a given row 1320 of flexible conducting FSS unit cells 1324, the flexible FSS unit cells 1324 remain separated from corresponding unit cells 1328 of the first conducting FSS layer 1308 by the elastic force of the flexible substrate 1314 material (State 1, FIG. 13A). When a voltage is applied between the first conducting FSS layer 1308 and a given row 1320 of flexible conducting FSS unit cells 1324 of the second conducting FSS layer 1312, the flexible FSS unit cells 1324 are pulled by electrostatic force closer to the rigid FSS layer 1308 (State 2, FIG. 13B). The change in air gap spacing between the two FSS sheets 1310, 1315 moves the resonant pass band frequency of the coupled pairs of unit cells 1324, 1328 up or down, depending on the specific FSS design. When the voltage is removed, the FSS sheets 1310, 1315 again separate as the result of elastic spring-back force exerted by the flexible FSS substrate 1314.

Figure 14C:
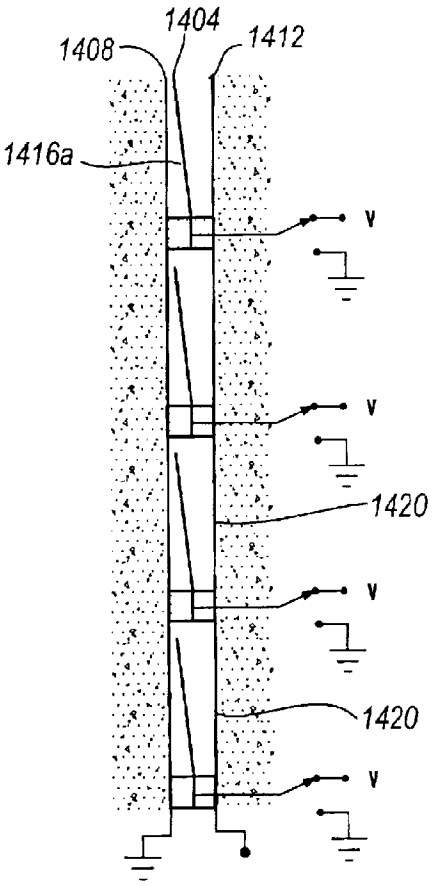
FIG. 14C is a cross-section of the symmetric reconfigurable lens of FIG. 14A, with the elements in a third position.
Figure 14B:
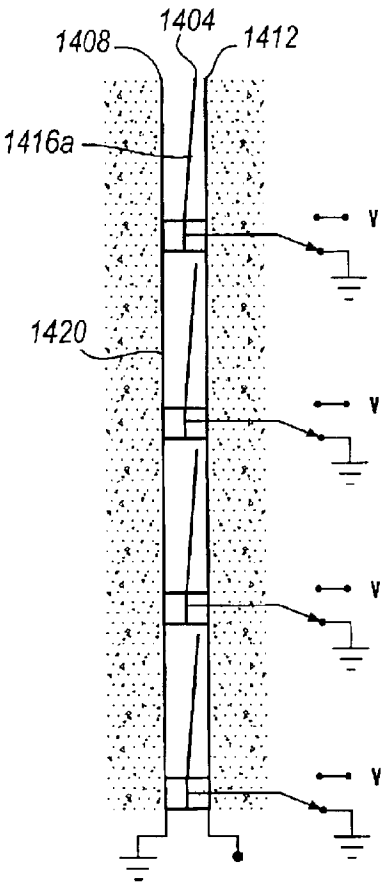
FIG. 14B is a cross-section of the symmetric reconfigurable lens of FIG. 14A, with the elements in a second position.
Figure 14A:
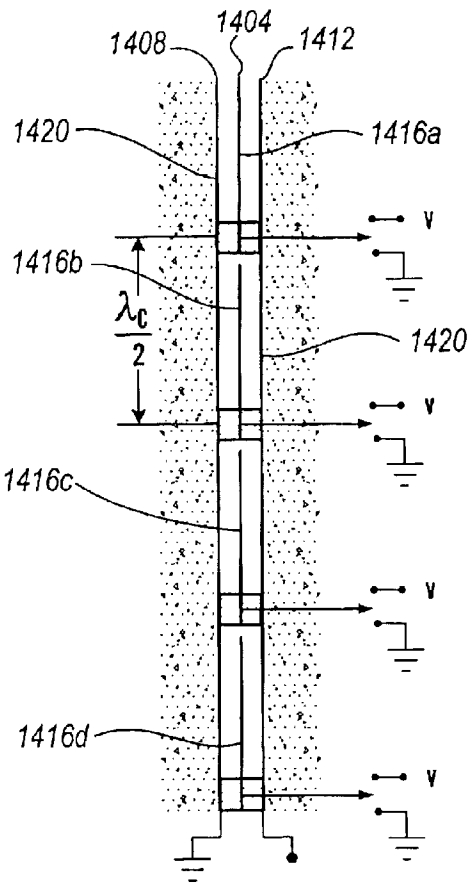
FIG. 14A is a cross-section of a symmetric reconfigurable lens with elements in a first position.

FIGS. 14A, 14B and 14C illustrate a symmetric form of a lens using FSS/PMEMS surfaces and its operational states. This configuration employs one flexible conducting FSS sheet 1404 surrounded by first 1408 and second 1412 rigid conducting FSS sheets. The first 1408 and second 1412 rigid FSS sheets are biased at a fixed relative potential difference, while each row 1416 of unit cells 1420 of the flexible center FSS sheet 1404 is biased individually. When no bias voltage is applied to the flexible FSS rows 1416 they are in an undefined "floating" state (FIG. 14A). In operational State 1 (FIG. 14B) a given row 1416 of unit cells 1420 (or all of the rows 1416, as illustrated in FIG. 14B) of the flexible FSS sheet 1404 are biased to a DC polarity opposite that of the second rigid FSS sheet 1412, and electrostatic attraction force pulls these two sheets together. In State 2 (FIG. 14C) the DC polarity of the flexible FSS sheet 1404 is reversed and the flexible FSS sheet 1404 is pulled in the opposite direction, towards the first rigid FSS sheet 1408. This bi-directional forcing function makes the symmetrical configuration largely independent of elastic characteristics of the flexible FSS sheet 1404, and therefore provides for more repeatable actuation. Second, the presence of the second rigid dielectric substrate as part of the second rigid FSS sheet 1412 provides a more balanced RF structure, which presents a better impedance match to free space, thereby enhancing transmission performance. Third, the two rigid sheets 1408, 1412 of the symmetrical structure provide environmental protection to the more delicate flexible sheet 1404 in between the rigid sheets 1408, 1412.

Figure 15B:
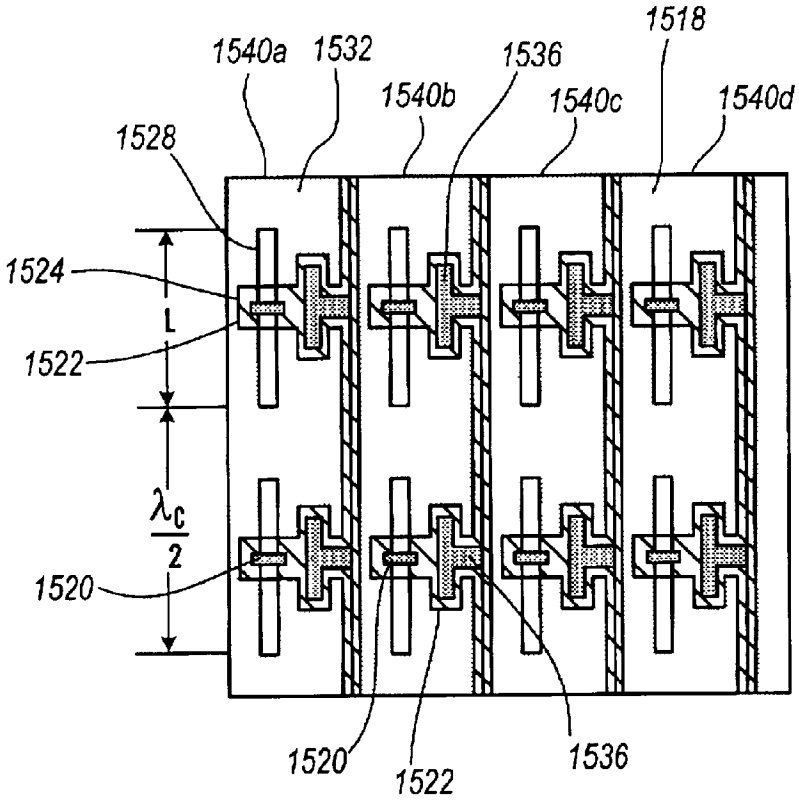
FIG. 15B illustrates a reconfigurable lens having slot elements and conducting dipole elements in accordance with an embodiment of the present invention.
Figure 15A:
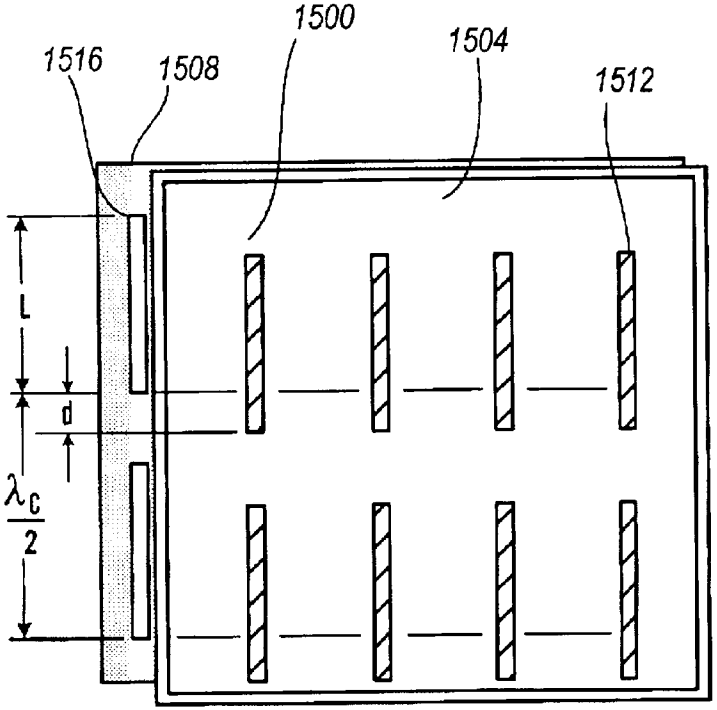
FIG. 15A illustrates a reconfigurable lens featuring slot elements in accordance with an embodiment of the present invention.

Two additional types of FSS/PMEMS unit cells or elements that may be utilized in connection with a reconfigurable lens in accordance with the present invention are illustrated in FIGS. 15A and 15B. These unit cells 1500, 1518 are designed to accommodate linear polarization only, but the same design principals can be applied to dual-polarized unit cells (for example the dual polarized unit cells illustrated in FIGS. 3 and 4). The first configuration (FIG. 15A) incorporates two or more tightly coupled resonant FSS sheets 1504, 1508, at least one of which is imprinted on thin flexible substrate to provide for flexure movement. The slot elements 1512 in one sheet 1504 are slightly offset relative to the slot elements 1516 in the second sheet 1508, so that when the two sheets are brought closer together by electrostatic attraction the resonant pass band frequency increases. In the second configuration (FIG. 15B) a small sub-resonant, isolated conducting dipole element 1520 provided on a thin flexible substrate 1522 of a first FSS sheet 1524 is pulled closer to the center of the resonant slot element 1528 formed as part of a second FSS sheet 1532, effectively loading the slot element 1528 and pulling its transmission pass band slightly down in frequency. The dipole 1520 is pulled by the means of an electrostatic force exerted between the second FSS sheet 1532 and a conducting patch 1536 which is deposited on the same flexible substrate 1522 as the dipole 1520. The patch 1536 is located far enough away from the dipole 1520 to prevent RF interaction between the two, and is electrically connected to the other patches in a given row 1540 of elements 1518, allowing edge DC bias control of the row 1540.

Figure 16:
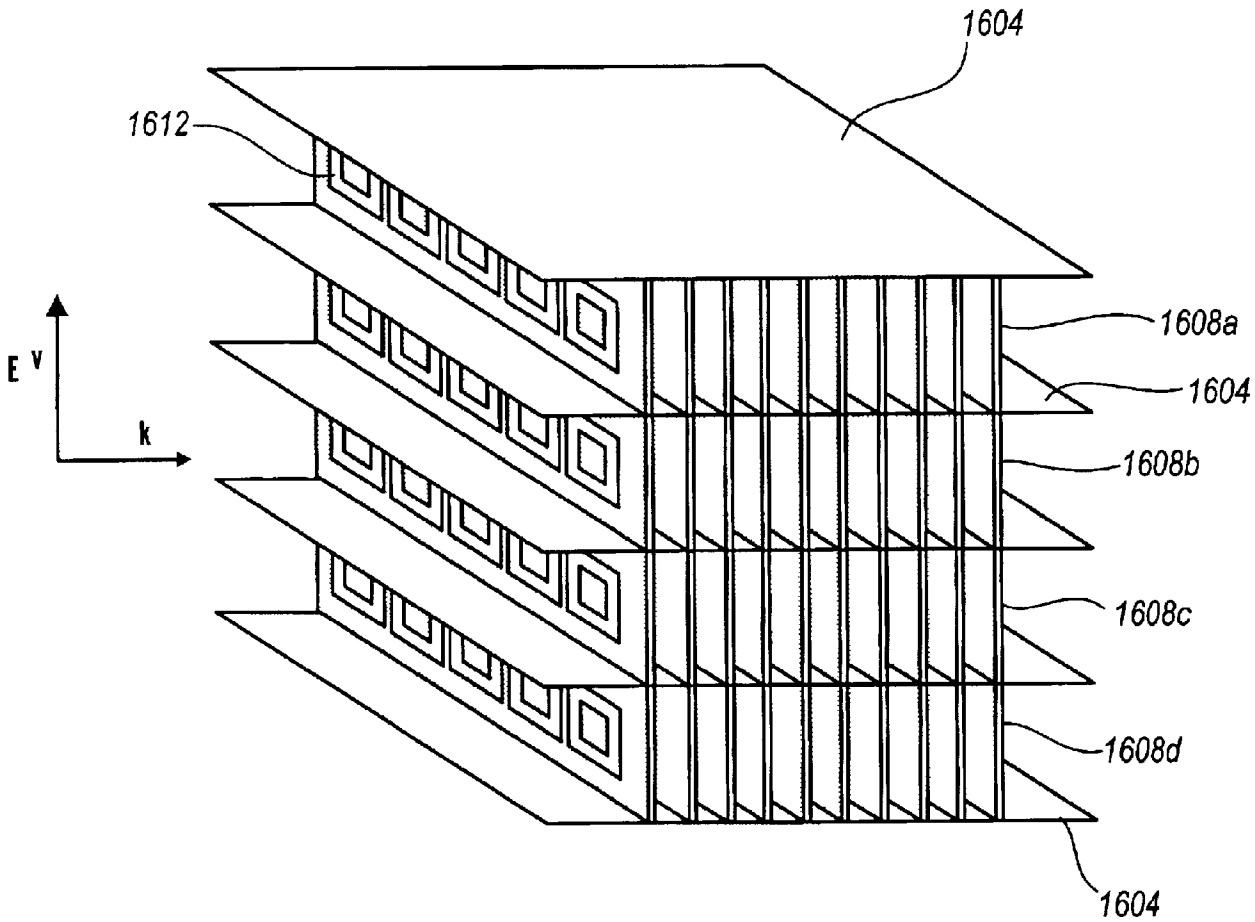
FIG. 16 is a perspective view of a reconfigurable lens having parallel conducting plates in accordance with an embodiment of the present invention.
Figure 17A:
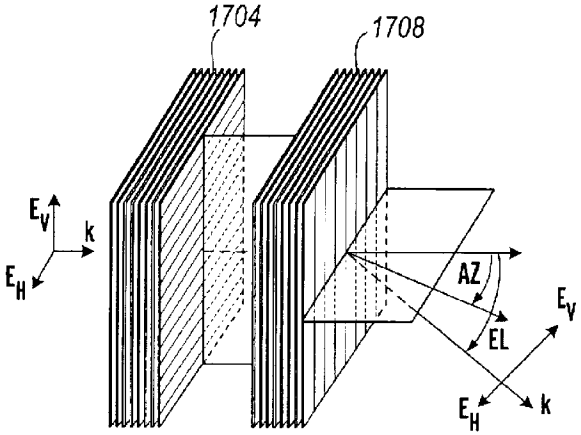
FIG. 17A is a perspective view of a multiple bit, two dimensional reconfigurable radio frequency lens in accordance with another embodiment of the present invention.
Figure 17B:
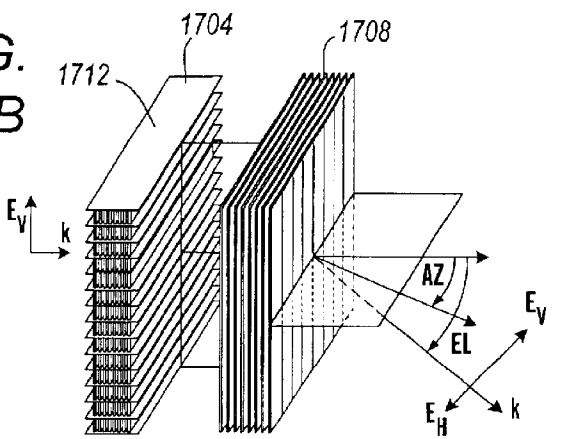
FIG. 17B is a perspective view of a multiple bit, two dimensional reconfigurable radio frequency lens in accordance with another embodiment of the present invention.
Figure 17C:
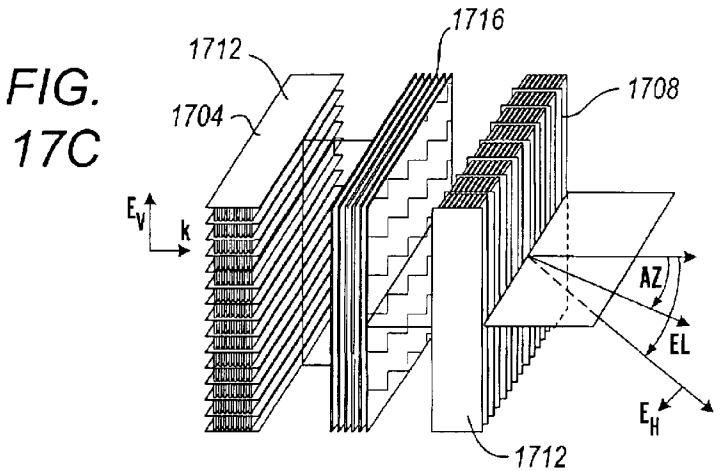
FIG. 17C is a perspective view of a multiple bit, two dimensional reconfigurable radio frequency lens in accordance with another embodiment of the present invention.
Figure 17D:
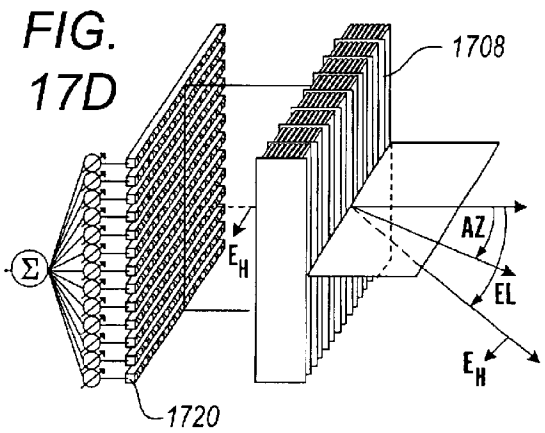
FIG. 17D is a perspective view of a multiple bit, two dimensional reconfigurable radio frequency lens in accordance with another embodiment of the present invention.

For applications where the FSS/PMEMS lens is required to transmit only linear polarization, parallel conducting plates 1604 may be added between each row 1608 of unit cells or elements 1612 as illustrated in FIG. 16. Such plates 1604 effectively isolate the fields propagating through adjacent rows 1608, as through adjacent parallel plate waveguides, and act to provide a cleaner transmitted phase envelope and reduce scan loss and pattern degradation.

In FIGS. 17A-17D, four basic configurations of FSS/PMEMS lenses are identified for the steering of an antenna beam in two dimensions. Option 1 (FIG. 17A) is the basic configuration of first 1704 and second 1708 1-D orthogonal lenses. The first lens 1704 steers the beam in elevation, while the second lens 1708 steers the beam in azimuth. Option 2 (FIG. 17B) incorporates conducting row-isolation plates 1712 in one of the 1-D lenses 1704 but is otherwise the same as option 1. Option 3 (FIG. 17C) incorporates conducting plates 1712 in both of the 1-D lenses and a polarization rotator 1716 in between lenses. Option 4 (FIG. 17D) is a hybrid approach wherein a conventional 1-D phased array 1720 illuminates a 1-D lens 1708 to achieve steering in elevation and azimuth.

Although the foregoing discussion has described particular geometries, dimensions, operating frequencies and phase shift amounts, the present invention is not so limited. For instance, unit cells comprised of circular arrangements of slots may be utilized. In addition, although a method of electrostatically controlling the distance between unit cells and adjacent FSS sheets has been described, other methods are available. For example, linear motors or other electromechanical actuators may be utilized. Furthermore, it is not necessary to control the distance between adjacent unit cells by rows or columns. For example, the distance between pairs of adjacent unit cells may be controlled individually.

In accordance with still another embodiment of the present invention, conventional methods of changing the resonant frequency of a surface, for example devices utilizing tunable ferroelectrics or diodes, are cascaded with one another. According to such an embodiment, the use of conventional cascaded radio frequency lenses or tunable stages cascaded together allows for additional steering or attenuation of radio frequency waves or radiation. In addition, by cascading a number of such devices, thereby providing a number of individually controllable stages, a steering or attenuation of a radio frequency wave or radiation can be controlled by selectively controlling each stage. Such conventional devices may include diode based devices, in which slots are selectively bridged, or devices incorporating ferroelectric material having resonant characteristics that can be altered by selectively applying a voltage.

In addition, it can be appreciated that the present invention may be utilized in connection with a conventional phased array antenna. For example, a phased array antenna capable of scanning in a first dimension may be used in connection with a lens in accordance with the present invention for scanning in a second dimension.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such or in other embodiments and with various modifications required by their particular application or use of the invention. It is intended that the appended claims be construed to include the alternative embodiments to the extent permitted by the prior art.

What is claimed is:

1. An antenna apparatus, comprising:

a first frequency selective surface; and a second frequency selective surface interconnected to said first frequency selective surface such that at least a first portion of said second frequency selective surface overlaps at least a first portion of said first frequency selective surface and such that a distance of said at least a first portion of said second frequency selective surface from said at least a first portion of said first frequency selective surface can be selectively altered, wherein in a first mode said at least a first portion of said second frequency selective surface is a first distance from said at least a first portion of said first frequency selective surface to present a first admittance to a signal having a first frequency, and wherein in a second mode said at least a first portion of said second frequency selective surface is a second distance from said at least a first portion of said frequency selective surface to present a second admittance to said signal having a first frequency.

2. The antenna apparatus of claim 1, wherein a second portion of said first frequency selective surface overlaps a second portion of said second frequency selective surface, wherein in a third mode said second portion of said first frequency selective surface is said first distance from said second portion of said second frequency selective surface to present said first admittance to said signal having a first frequency, and wherein in a fourth mode said second portion of said first frequency selective surface is a third distance from said second portion of said second frequency selective surface to present a third admittance to said signal having a first frequency.

3. The antenna apparatus of claim 1, wherein said first frequency selective surface comprises an array of unit cells, and wherein said second frequency selective surface comprises an array of unit cells.

4. The antenna apparatus of claim 3, wherein at least a majority of said unit cells of said first frequency selective surface have a unit cell size that is different from a unit cell size of at least a majority of said second frequency selective surface.

5. The antenna apparatus of claim 3, wherein said first frequency selective surface is registered with said second frequency selective surface such that at least a first edge of a unit cell of said first frequency selective surface is not aligned with at least a first edge of a unit cell of said second frequency selective surface.

6. The antenna apparatus of claim 3, wherein said unit cells of said first frequency selective surface comprise resonant slots.

7. The antenna apparatus of claim 1, wherein said first and second frequency selective surfaces comprise a flexible substrate coupled to an electrically conductive layer, and wherein resonant slots are formed in said conductive layer.

8. The antenna apparatus of claim 1, further comprising a voltage source, wherein in said second mode of operation a non-zero voltage potential is established between said at least a first portion of said first frequency selective surface and said at least a first portion of said second frequency selective surface.

9. The antenna apparatus of claim 1, further comprising:

a third frequency selective surface;

a fourth frequency selective surface interconnected to said third frequency selective surface such that at least a first portion of said fourth frequency selective surface overlaps at least a first portion of said third frequency selective surface and such that a distance of said at least a first portion of said fourth frequency selective surface from said at least a first portion of said third frequency selective surface can be selectively altered, wherein in a third mode said at least a first portion of said fourth frequency selective surface is a third distance from said at least a first portion of said third frequency selective surface to present a third admittance to a signal having a first frequency, wherein in a fourth mode said at least a first portion of said fourth frequency selective surface is a fourth distance from said first portion of said third frequency selective surface to present a fourth admittance to said signal having a first frequency, wherein said first and second frequency selective surfaces comprise a first phase shifter, wherein said third and fourth frequency selective surfaces comprise a second phase shifter, wherein said first and second phase shifters are positioned such that at least a portion of said first phase shifter overlaps at least a portion of said second phase shifter.

10. The antenna apparatus of claim 1, wherein in said first mode of operation said frequency selective surfaces are tuned to present a low transmission loss to said signal having a first frequency, and wherein in said second mode of operation said frequency selective surfaces are de-tuned to present a high transmission loss to said signal having a first frequency.

11. A method of shifting the phase of a radio frequency signal, comprising:

generating a radio frequency signal;

positioning a first frequency selective surface in a path of said radio frequency signal;

positioning a second frequency selective surface in a path of said radio frequency signal;

positioning at least a first portion of said second frequency selective surface a first distance from at least a first portion of said first frequency selective surface to phase shift at least a first portion of said radio frequency signal by a first amount; and positioning said at least a first portion of said second frequency selective surface a second distance from said at least a first portion of said first frequency selective surface to phase shift said at least a first portion of said radio frequency signal by a second amount.

12. The method of claim 11, wherein said step of positioning said at least a first portion of said second frequency selective surface a first distance from said first frequency selective surface to phase shift said radio frequency signal by a first amount comprises introducing a first voltage potential between said at least a first portion of said first frequency selective surface and said at least a first portion of said second frequency selective surface, and wherein said step of positioning said at least a first portion of said second frequency selective surface a second distance from said at least a first portion of said first frequency selective surface to phase shift said radio frequency signal by a second amount comprises introducing a second voltage potential between said at least a first portion of said first frequency selective surface and said at least a first portion of said second frequency selective surface.

13. The method of claim 11, wherein said first and second frequency selective surfaces comprise arrays of unit cells, and wherein said at least a first portion of said first frequency selective surface comprises at least a first column of unit cells.

14. The method of claim 13, wherein at least a first edge of each of said unit cells of said first frequency selective surface are not aligned with at least a first edge of a corresponding one of said unit cells of said second frequency selective surface.

15. The method of claim 14, wherein at least a majority of said unit cells of said first frequency selective surface have a unit cell size that is different from a unit cell size of at least a majority of said unit cells of said second frequency selective surface.

16. The method of claim 11, wherein said step of positioning said at least a first portion of said second frequency selective surface a second distance from said at least a first portion of said first frequency selective surface comprises positioning substantially all of said second frequency selective surface a second distance from said first frequency selective surface, wherein said frequency selective surfaces are de-tuned to form a closed shutter with respect to said radio frequency signal.

17. A radio frequency lens, comprising:

a first frequency selective surface, comprising:

an array of unit cells;

a second frequency selective surface, comprising;

an array of unit cells, wherein said first and second frequency selective surfaces are registered with respect to one another such that at least a first edge of at least a first unit cell of said first frequency selective surface is not aligned with at least a first edge of at least a first unit cell of said second frequency selective surface, wherein said first frequency selective surface and said second frequency selective surface are a first distance from one another when said lens is in a first mode of operation, and wherein at least a portion of said second frequency selective surface is movable with respect to at least a first portion of said first frequency selective surface to position said at least a first portion of said second frequency selective surface a second distance from said at least a first portion of said first frequency selective surface when said lens is in a second mode of operation.

18. The radio frequency lens of claim 17, wherein at least a majority of said unit cells of said first frequency selective surface have a unit cell size that is different from a unit cell size of at least a majority of said unit cells of second frequency selective surface.

19. The radio frequency lens of claim 17, further comprising a voltage source, wherein in said first mode of operation a first potential difference between said at least a first portion of said first frequency selective surface and said at least a first portion of said second frequency selective surface is established, and wherein in a second mode of operation a second potential difference is established between said at least a first portion of said first frequency selective surface and said at least a first portion of said second frequency selective surface.

20. The radio frequency lens of claim 17, wherein said second frequency selective surface further comprises:

a flexible substrate; and an electrically conductive layer, interconnected to said flexible substrate, wherein said unit cells are defined by slots formed in said conductive layer.

21. The radio frequency lens of claim 17, wherein said first portion of said first frequency selective surface is defined by electrically insulating a first column of unit cells from a second portion of said first frequency selective surface.

22. The radio frequency lens of claim 17, wherein in said second mode of operation radio frequency radiation having at least a first frequency propagating through said lens experiences a transmission loss that is greater than a transmission loss experienced by said radio frequency radiation when said radio frequency lens is in said first mode of operation.

23. The radio frequency lens of claim 22, wherein said radio frequency lens functions as an open shutter in said first mode of operation and a closed shutter in said second mode of operation.

24. A method of steering a radio frequency beam, comprising:

providing a first array of unit cells;

providing a second array of unit cells;

registering said first array with respect to said second array, wherein at least a first edge of a one of said unit cells of said first array is not aligned with at least a first edge of a corresponding one of said unit cells of said second array;

separating said first and second arrays by a first amount, wherein a first phase shifter is formed, and wherein a first radio frequency signal incident on said first and second arrays is phase shifted a first amount; and separating at least a portion of said first array from at least a portion of said second array by a second amount, wherein said first radio frequency signal incident on said at least a portion of said first array and at least a portion of said second array separated by said second amount is phase shifted a second amount.

25. The antenna apparatus of claim 24, wherein at least a majority of said unit cells of said first array have a unit cell size that is different from a unit cell size of at least a majority of said unit cells of said second array.

26. The method of claim 24, wherein said unit cells of said first array are divided into columns of unit cells, and wherein a first column of said unit cells is not electrically interconnected to a second column of said unit cells.

27. The method of claim 24, wherein said first array of unit cells comprises:

a dielectric substrate; and an electrically conductive layer, wherein said electrically conductive layer is patterned to define said unit cells.

28. The method of claim 27, wherein said unit cells are defined by slots formed in said electrically conductive layer.

29. The method of claim 27, wherein said dielectric substrate is flexible.

30. The method of claim 24, wherein said first array and said second array are substantially planar.

31. The method of claim 24, wherein said separation between said at least a portion of said first array and said at least a portion of said second array by said second amount is achieved by introducing an attractive force between said at least a portion of said first array and said at least a portion of said second array.

32. The method of claim 31, wherein said attractive force comprises an electrostatic force.

33. The method of claim 31, wherein said attractive force acts in opposition to a spring force tending to maintain said separation between said first array and said second array in said first amount.

34. The method of claim 33, wherein said separation between said first array and said second array by said first amount is achieved by removing an attractive force between said at least a portion of said first array and said at least a portion of said second array.

35. The method of claim 24, wherein an admittance produced by said at least a portion of said first array and said at least a portion second array with respect to said incident signal is altered when said portions are separated by a second amount as compared to when said portions are separated by a first amount.

36. The method of claim 24, further comprising:

providing a third array of unit cells;

providing a fourth array of unit cells;

registering said third array with respect to said fourth array, wherein at least a first edge of a one of said unit cells of said third array is not aligned with at least a first edge of a one of said unit cells of said fourth array;

separating said third and fourth arrays by a third amount, wherein a second phase shifter is formed;

separating at least a portion of said third array from at least a portion of said fourth array by a fourth amount; and registering said first phase shifter with respect to said second phase shifter, wherein said first radio frequency signal, incident on said first and second phase shifters, is phase shifted a third amount when said third and fourth arrays of said second phase shifter are separated by said third amount, and wherein said radio frequency signal incident on said at least a portion of said third array and at least a portion of said fourth array is phase shifted by a fourth amount when said at least a portion of said third array and said at least a portion of said fourth array are separated by said fourth amount.

37. The method of claim 36, wherein a portion of said first radio frequency signal incident on said at least a portion of said first array and said at least a portion of said second array separated by said second amount and incident on said at least a portion of said third array and said at least a portion of said fourth array separated by said fourth amount is phase shifted a fifth amount.

38. The method of claim 36, wherein said unit cells of said first array are divided into columns of unit cells, and wherein a first column of said unit cells is not electrically interconnected to a second column of said unit cells, and wherein said unit cells of said third array are divided into rows of unit cells, wherein a first row of said unit cells is not electrically interconnected to a second row of said unit cells, wherein said radio frequency signal incident on said at least a portion of said first array and said at least a portion of said second array and incident on said at least a portion of said third array and said at least a portion of said fourth array may be scanned in two dimensions.

39. The method of claim 36, further comprising interposing a spacer between said first and second phase shifters, whereby a first spacing is maintained between said first and said second phase shifters.

40. A tunable device for steering radio frequency signals, comprising:

a first tunable stage operable to selectively phase shift an incident radio frequency signal having a first frequency by a first amount in a first mode of operation and by a second amount in a second mode of operation;

a second tunable stage operable to selectively phase shift an incident radio frequency signal having a first frequency by a third amount in a first mode of operation and by a fourth amount in a second mode of operation, wherein said second tunable stage at least substantially overlaps said first tunable stage, wherein an incident radio frequency signal can be steered by selectively controlling said modes of operation of said first and second tunable stages.

41. The device of claim 40, wherein said first tunable stage comprises a plurality of diodes for controlling an index of refraction of said lens.

42. The device of claim 40, wherein said first tunable stage comprises a ferroelectric material having a first radio frequency resonance in said first mode of operation and a second radio frequency resonance in said second mode of operation.

* * * * *